United States Patent [19]

Horton

[11] 4,316,498

[45] Feb. 23, 1982

[54] INVESTMENT SHELL MOLDING MATERIALS AND PROCESSES

[75] Inventor: Robert A. Horton, Chesterland, Ohio

[73] Assignee: Precision Metalsmiths, Inc., Cleveland, Ohio

[21] Appl. No.: 113,180

[22] Filed: Jan. 18, 1980

[51] Int. Cl.[3] ..... B22C 1/00

[52] U.S. Cl. ..... 164/519; 164/361; 106/38.9

[58] Field of Search ..... 164/25, 26, 131, 132, 164/41, 361; 106/38.2, 38.22, 38.27, 38.9

[56] References Cited

U.S. PATENT DOCUMENTS

| | | | |
|---|---|---|---|
| 3,232,771 | 2/1966 | Pearce | 106/38.35 |
| 3,326,269 | 6/1967 | Schneider | 164/43 |
| 3,452,804 | 7/1969 | Mellen, Jr. et al. | 164/26 |

FOREIGN PATENT DOCUMENTS

| | | | |
|---|---|---|---|
| 52-15453 | 4/1977 | Japan | 164/41 |
| 996297 | 6/1965 | United Kingdom . | |
| 482411 | 3/1976 | U.S.S.R. | 106/38.27 |

*Primary Examiner*—Robert D. Baldwin
*Assistant Examiner*—K. Y. Lin
*Attorney, Agent, or Firm*—Watts, Hoffmann, Fisher and Heinke Co.

[57] ABSTRACT

A ceramic shell mold having the properties of being easily removed from the metal castings, high permeability, and a fired strength that can be controlled at levels lower than conventional molds, characterized in that the refractory used to make the mold is at least in part hydrated alumina.

2 Claims, 2 Drawing Figures

INVESTMENT SHELL MOLDING MATERIALS AND PROCESSES

DESCRIPTION

This invention relates generally to the investing casting art, and more specifically to new methods and materials for making ceramic shell molds.

Ceramic shell molds are made by building up layers of refractory material around disposable patterns that are subsequently removed from the molds. The patterns are replicas of the parts to be cast in metal and are formed of an expendable material, such as wax or a suitable synthetic resin or a blend of wax and resin. The patterns are assembled to a runner system including a central support or sprue member to form what is commonly known as a set-up or tree. The formation of the shell mold around the set-up or tree is generally accomplished by applying a refractory slurry coating of controlled viscosity followed by directional draining to coat the patterns completely. After draining excess slurry from the tree, the slurry coating is sanded or stuccoed while wet with coarser refractory materials. This layer is hardened, as by forced air drying at room temperature. The result is a layer of ceramic material having refractory particles embedded in the surface. After the first ceramic layer is sufficiently hard and dry, the steps of coating, draining, stuccoing and drying are repeated until a refractory shell having sufficient thickness to resist the stresses occurring in subsequent operations has been built up around the tree. In a subsequent pattern removal operation, the tree including the patterns is removed from the shell mold and the mold is prepared for the casting operation by firing at an elevated temperature, e.g. 1800° F.

The refractory slurry used for dipping and coating the patterns generally comprises a refractory powder and a binder. The binder is typically either an aqueous colloidal solution of silica or hydrolized ethyl silicate. Conventionally used refractory powders include fused and crystalline silica, zircon, zirconia, alumina, calcium zirconate, various aluminum silicates and the like. The stuccoing material is generally larger in particle size than the refractory powder used in the slurry. Refractories typically employed for stuccoing include granular zircon, fused silica, silica, various aluminum silicates and the like.

The after-cast operations of removing the sintered or fused mold material from the finished metal castings have presented long-standing problems in the investment casting industry, and there has been considerable interest in the development of a so-called "soft shell" that would alleviate these problems. The current practice generally involves subjecting the castings to a knockout operation in which a pneumatic hammer is used to remove as much mold material as possible. When it is not possible to remove all of the mold material by a knockout operation, the castings are subjected to a molten salt bath at a temperature of about 950° F. or higher.

The use of a molten salt bath to remove sintered or fused mold material from the castings is an especially undesirable practice. Because of the high temperatures involved and the caustic nature of the molten salt, the operation is difficult and unpleasant and involves safety hazards. In addition, the bath must be cleaned and replenished on a regular basis which adds to the cost of the operation. The disposal of the spent materials presents a serious problem because of environmental considerations and regulations. Castings which have been subjected to a molten salt bath generally have a rusty, undesirable appearance and often must be chemically cleaned or sandblasted.

DISCLOSURE OF INVENTION

The present invention is concerned with new methods and materials for making ceramic shell molds that can be removed from the finished castings more easily than in the past. The invention is also concerned with the production of ceramic shell molds that can be made to exhibit any desired fired strength throughout a wide range of strengths, and which are further characterized by high permeability.

It has been discovered that it is possible to produce "soft" ceramic shell molds having unexpectedly superior knockout properties by substituting hydrated alumina (aluminum hydroxide) for all or part of the silicas or other refractory powders commonly used to formulate ceramic shell molding slurries. The new slurries containing hydrated alumina result in mold shells which can be easily removed from the castings even when they are small and so close together that the spaces between the castings are filled in solid with mold material. In some instances, the mold material can be removed from the castings by a pneumatic hammer or other cleaning operation without resorting to a salt bath treatment. Even when a salt bath treatment is required, as when the castings have narrow slots, openings or holes, the load on the bath is greatly reduced because more mold material is removed by preliminary knockout procedures than in the case of conventionally produced molds. The amount of salt and the attendant disposal problem is reduced, as is the time of bath treatment.

The new mold material also makes it possible to employ cleaning operations other than salt bath treatment. For example, the soft shell material can be removed by low pressure water spray at a pressure of about 1000 psi compared to pressures of 10,000 psi or higher required to remove conventional shell material. The new shell material is soft enough that it can be removed from cored holes and the like by hand using a suitable implement. It is also possible to remove the material chemically or by sandblasting in order to take advantage of bulk treatment.

The invention provides a slurry composition comprising a suspension of refractory powder in a liquid binder, the powder being at least in part hydrated alumina. In particularly suitable compositions, the hydrated alumina is present in an amount of from about 20–100% by weight of the refractory material. If desired, minor amounts of wetting agent and an anti-foam agent could be included in the composition in accordance with conventional practice. The invention also provides a refractory mold which, before firing, consists essentially of particulate refractory material and a binder, the refractory material being at least in part hydrated alumina.

The new slurry has excellent dipping and draining characteristics. The hydrated alumina refractory also permits a wide selection of binders and stucco materials to be used in making the shell molds.

The fired strength of the mold that is produced can be varied over a wide range by selecting the amount of hydrated alumina used in formulating the slurry. The fired strengths of the molds can be gradually and controllably reduced with only a very minor decrease in green strength by increasing the amount of hydrated alumina. Molds having fired strengths about equal or only slightly greater than the green strengths can be made using refractory powder which is about 20% by weight hydrated alumina. When the hydrated alumina content is decreased below 20%, the fired strength increases until it approaches that of a mold prepared with 100% of conventionally used refractories. When the refractory material is all hydrated alumina, the fired strength is less than half that of the green strength so that the shell is very soft and can be easily removed from the castings Although the strength level is very low, it is adequate for some purposes, especially when the metal castings are susceptible to hot tearing. The range of usefulness of the soft shell mold can be extended by increasing the shell wall thickness or by backing up the shell during casting with granular refractory material.

An important and advantageous use of a very weak and soft shell coating made possible by the present invention is when it is used in conjunction with stronger coats of a conventional nature. For example, hydrated alumina coats can be alternated with conventional coats or they can be used for the earlier coats and then backed up with conventional coats or they can be sandwiched between conventional coats. In all of these cases, the shell tends to cleave along the weak alumina hydroxide coats during knockout so that the stronger conventional coats are not supported and break away readily from the castings.

A reduced fired strength and the improved knockout properties which characterize the soft shell molds of the invention may be due to a large volume reduction of the hydrated alumina refractory during firing. The calculated loss in volume in the solid phase when hydrated alumina decomposes to aluminum oxide is about 60%. This loss in volume and resulting porosity is in addition to the normal porosity that results from evaporation of the liquid vehicle of the binder. The porosity is distributed throughout the mold structure and may be between the refractory particles as well as within them where decomposition has occurred.

In spite of the large loss of volume within the refractory powder phase, the molds of the invention made with hydrated alumina do not exhibit objectionable shrinkage during firing. Equally important is the fact that molten metals, including steel, can be cast against the highly porous mold walls to yield smooth surfaces on the castings. In addition to providing for reduced fired strength, the mold porosity has the advantage of permitting easy venting of air and gases from the mold cavities during casting, and facilitating filling of thin sections in the metal castings.

Other advantages and a fuller understanding of the invention will be had from the following detailed description which sets forth illustrative examples.

BEST MODE FOR CARRYING OUT THE INVENTION

EXAMPLE I

A series of tests were conducted to demonstrate the effect on green strength and fired strength of substituting a hydrated alumina for zircon, a conventionally used ceramic shell refractory. Eight compositions were tested ranging from 100% zircon to 100% hydrated alumina. In each case, the same binder, stucco materials, and number of coatings were used.

The binder liquid consisted of:

Colloidal silica—3 lbs
Wetting Agent—2 ml
Silicone Antifoam—14 ml

The colloidal silica was an aqueous colloidal silica sol stabilized with approximately 0.45% $Na_2O$, and containing 30% $SiO_2$ of an average particle size of 8 millimicrons. The wetting agent was sodium dioctylsulfosuccinate diluted to 75 percent with a water and alcohol mixture, and the silicone antifoam was a 30% silicone emulsion.

The zircon particle size was 325 mesh. The hydrated alumina had an average particle size of 6.5 to 8.5 microns and typically contained 0.01% $SiO_2$, 0.006% $Fe_2O_3$, 0.15% $Na_2O$. The stucco material was a calcined kaolin typically containing 47.5% $Al_2O_3$ and 49.3% $SiO_2$.

In each test, the refractory powder was added to the liquid binder and stirred into suspension until a good dipping consistency was obtained. The slurry was then subjected to a vacuum to remove entrained air. Six dip coatings were applied and each was stuccoed and dried. A fine grain stucco material was used for the first coating, a medium grade for the second coating and a coarse grade for the last four coatings.

Specimens prepared according to the foregoing procedure and containing varying amounts of hydrated alumina were tested to determine the green or unfired strengths and the strengths after having been fired to 1800° F. for one hour. The results are plotted in the graph of FIG. 1.

Figure 1:
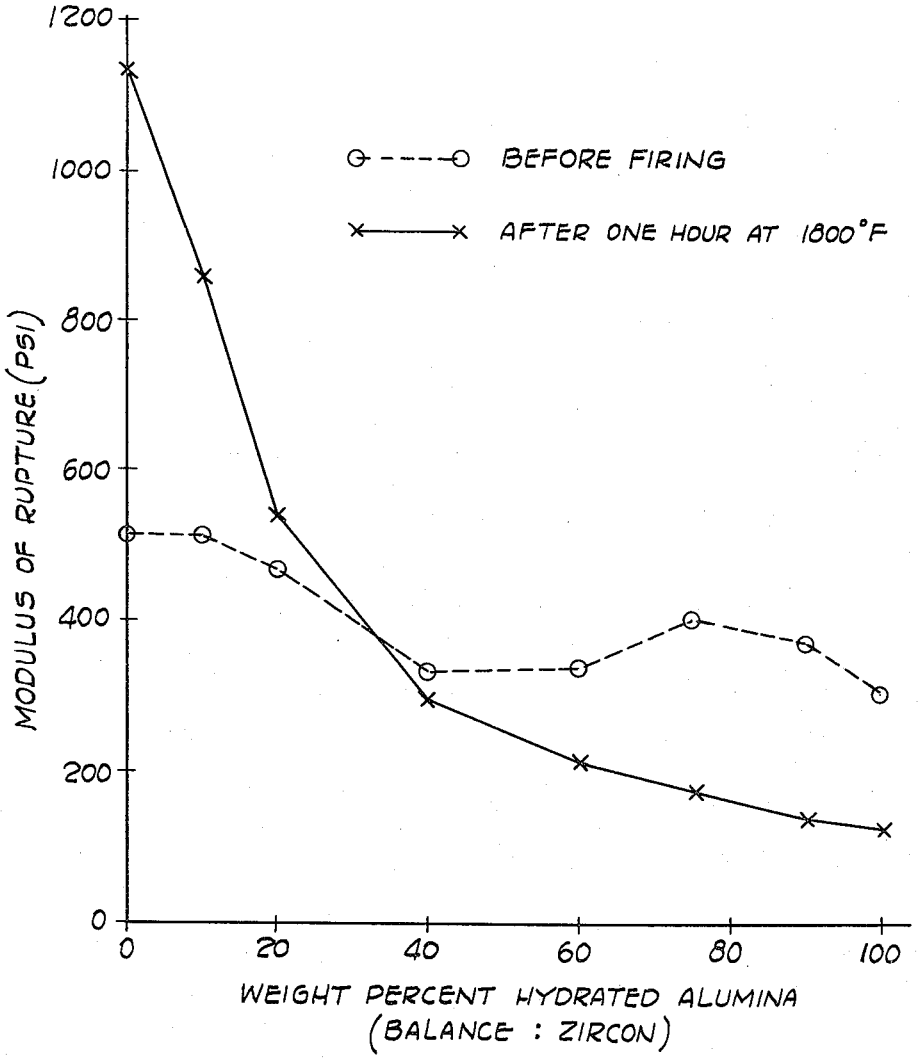
FIG. 1 is a graph showing the effect of hydrated alumina content on both fired and green strengths.

It will be seen from FIG. 1 that the substitution of hydrated alumina for zircon produced a large and continuous reduction in fired strength with only a small decrease in green strength. For example, the substitution of hydrated alumina for 20% of the zircon reduced the fired strength approximately 52.6% with only a minor decrease in green strength of about 8.6%. The substitution of hydrated alumina for 20 to 100% of the zircon reduced the fired strength from about 540 psi to about 130 psi or about 76%, while the green strength was reduced from about 470 psi to 310 psi or about 34%. The change in green strength from 40 to 100% hydrated alumina is negligible.

By varying the percentage of hydrated alumina, the fired strength can be adjusted to any selected level over an almost nine fold range extending from a weak and soft shell at one end to an excessively strong fired strength at the other. Excessive fired strength represented by a 100% zircon content in the graph makes it difficult to remove the shell material from closely spaced castings or from between closely spaced walls of the same casting during the knockout operation. It also promotes hot tearing in alloys and casting configurations which are prone to this type of defect. When the refractory is all hydrated alumina, the fired strength is less than one-half of the green strength and such a shell is very soft and can be easily removed from the castings. The range of usefulness of a 100% hydrated alumina refractory composition can be extended by increasing the shell wall thickness, or by backing up the shell during casting with granular refractory material, or by using soft shell coatings in conjunction with stronger ones formed by compositions containing lesser amounts of hydrated alumina.

Based on the tests reported in FIG. 1, coating compositions containing from about 20 to 100% hydrated alumina are preferred because it is easier to control the fired strength. While compositions containing lesser amounts of hydrated alumina are useful, the rapid change in fired strength resulting from slurries containing less than about 20% hydrated alumina may make it difficult to achieve a desired strength level.

EXAMPLE II

A ceramic shell slurry was prepared containing calcined aluminum oxide as the refractory powder, and it was compared to a second slurry having hydrated alumina substituted for one-half of the calcined alumina.

The binder liquid used in formulating the slurry consisted of:

Colloidal silica—5 lbs
Wetting agent—10 drops
Octyl alcohol—10 ml

The colloidal silica, wetting agent, and hydrated alumina were the same as used in Example I. The calcined alumina was a high purity alpha alumina, 325 mesh.

The ratio of refractory material to liquid binder was adjusted to bring the viscosity in the range of 1000–1050 centipoise (Brookfield viscometer, Number 3 spindle, 20 rpm) for each slurry. A first coat was applied from each slurry and stuccoed with fused alumina grain of a size designated as 54 grit and air dried. The slurries were then thinned by adding more binder solution to a viscosity in the range of 750–775 centipoise, and second coats were applied and stuccoed with the same fused alumina.

The slurries were thinned further to a range of 500–525 centipoise and four additional coats were applied. Each coat was stuccoed with fused alumina of a size designated as 38 grit and was air dried.

Strength tests of specimens were run before firing and after firing to 1800° F. for two hours followed by cooling to room temperature. The results are set forth in the following table:

| | Calcined Alumina | 50 % Calcined Alumina 50% Hydrated Alumina |
|---|---|---|
| Green | 494 psi | 362 psi |
| Fired | 1771 psi | 367 psi |

It will be seen from the table that an enormous reduction in fired strength was achieved by substituting hydrated alumina for 50% of the calcined alumina. The 50% substitution reduced the fired strength by about 79%. The green strength of the calcined alumina specimen was very close to that of the 100% zircon specimen reported in Example I. It will also be seen that the 50% mixture of hydrated alumina and calcined alumina exhibited a green strength which was very close to the green strength of the 50% mixture of hydrated alumina and zircon reported in Example I. As in the case of Example I, the substitution of hydrated alumina for 50% of the conventional refractory resulted in a relatively small reduction in green strength.

EXAMPLE III

Figure 2:
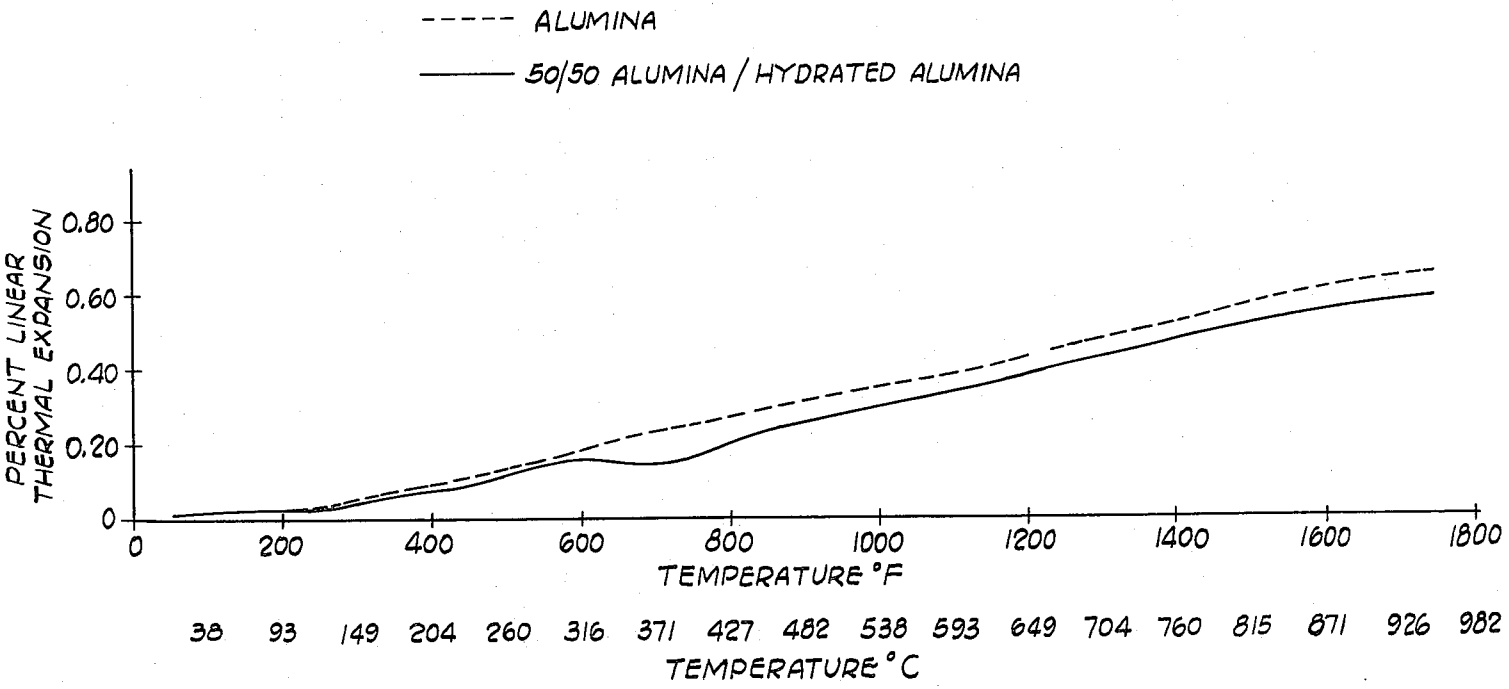
FIG. 2 is a graph of thermal expansion of ceramic mold specimens produced with a conventional slurry made with calcined alumina and a new slurry containing 50 percent hydrated alumina as the refractory.

Thermal expansion test specimens were prepared using the same slurries and procedures reported in Example II. The results are reported in the graph labeled FIG. 2. It will be seen that the thermal expansion curve of a specimen prepared from the slurry containing a 50% mixture of hydrated alumina and calcined alumina is very close to the thermal expansion curve of the specimen prepared from the slurry containing 100% calcined alumina. These results show that the 60% calculated loss in volume occurring on decomposition of the hydrated alumina goes largely into creating internal porosity rather than causing mold shrinkage.

EXAMPLE IV

A ceramic shell slurry was prepared consisting of:

Colloidal silica—11 lbs
Wetting agent—13 ml
Silicone antifoam—68 ml
Hydrated alumina—17 lbs, 1 oz The colloidal silica was an aqueous colloidal silica sol containing typically 30% $SiO_2$ of an average particle size of 12 millimicrons, stabilized with sodium as the counter ion, and having the surface modified with aluminate ions.

A slurry was made up in a conventional manner. The wetting agent and the antifoam were added to the colloidal silica, and then the hydrated alumina was stirred into suspension. A very smooth slurry with excellent dipping and draining characteristics was obtained.

The slurry was used to make a ceramic shell mold around the pattern setup carrying 126 patterns made of a wax-resin blend.

Seven coats of the slurry were applied by dipping. Each layer was stuccoed with refractory particles and dried before the next coating was applied. The first three coats were applied under a vacuum and the last four coats were applied without a vacuum. The stucco particles used throughout were of a alumina-silica grog widely used for this purpose in the investment casting industry. The first two coats were stuccoed with a fine grain stucco, the third with an intermediate grade material, and the last four with a coarse grade stucco in accordance with known practice.

After the seven coats had been applied and dried, the center tree was removed from the mold and the mold was de-waxed in a steam autoclave operating at 110 psi pressure. There was no cracking of the mold during this operation and the mold was found to have good green strength which permitted it to be readily handled.

The mold was then fired at 1800° F. for one hour. A resin bonded sand core having a thin refractory coating on its outer surface and preheated to 250° F. was placed inside the mold and the assembly was arranged in a suitable casting chamber for receiving molten metal. The inner surface of the mold and the outer surface of the core served to form a hollow sprue gating system having a $\frac{1}{4}$ inch wall thickness.

A partial vacuum of six inches mercury below atmospheric pressure was drawn in the casting chamber to hold the mold and core in place and to help evacuate air from the mold cavity during pouring of the molten metal. Fourteen pounds of a low alloy steel (SAE 6150)

at 2950° F. was poured into the mold and allowed to solidify.

After cooling, the refractory mold was easily removed from around the castings using a pneumatic hammer even though the castings were mounted very close together in an arrangement which normally makes it difficult to remove the mold material. The particular castings in this Example had a thin hole about 3/16 inches in diameter and 174 inch long. The mold material remaining in these holes was so soft that it could be easily removed with a straightened paperclip. It could also be easily removed by sandblasting or by low pressure water blasting. The resulting castings had a smooth surface and were satisfactory in all respects.

EXAMPLE V

A binder solution was made up using the same ingredients reported in Example IV in the following proportions:

Colloidal silica—1 lb, 8 oz
Wetting agent—1 ml
Silicone antifoam—3 ml

A laboratory grade of fine aluminum hydroxide was added to the binder liquid and stirred into suspension until a viscosity reading of 1400 centipoise was obtained.

A pattern set-up comprising two small die insert patterns mounted on a wax base was processed using the slurry. The slurry was vacuumed to remove air bubbles, but the individual slurry coatings were without vacuuming. The stuccoes used were the same as reported in Example I.

One coat was applied, stuccoed with fine calcined kaolin particles and dried. The viscosity of the slurry was then reduced to 800 centipoise for the second and third coats. An intermediate stucco size grain was used on the second coat and the coarse size on the third coat. The viscosity of the slurry was reduced further to 600 centipoise and three more coats were applied. These coats were stuccoed with coarse calcined kaolin particles.

After drying, the shell was placed in an autoclave to melt out the pattern material. It was then fired to 1600° F. and cooled to room temperature for examination. The shell was very soft and was found to have a smooth mold surface free of cracks.

The mold was then re-fired to 1000° F. and filled with aluminum alloy at 1350° F. After cooling, most of the shell mold was easily removed by hand using a hammer. What little material that remained was taken off by a low pressure water blast. The aluminum castings had smooth surfaces and were satisfactory in all respects.

In a further test, several pieces of a shell material that had been removed from the castings were fired to 2950° F. in an electric furnace, held 4½ hours at that temperature, and then cooled in the furnace. The pieces were found to be very soft even though they had been fired for an extended period at the same temperature as the molten steel used in Example IV. The shell material was sufficiently soft that it could be easily disintegrated with a finger nail or by light rubbing on a hard surface.

EXAMPLE VI

A mold was prepared using the slurry and stuccoes reported in Example IV in conjunction with conventional slurries. The conventional slurries were used for the first coat and for the outer two coats. Four coats of the hydrated alumina slurry were sandwiched in between.

The slurry used for the first coat consisted of:

Colloidal silica—10 lbs
Wetting Agent—13 ml
Antifoam—16 ml
Refractory powder—24½ lbs The refractory powder consisted of 45 percent 325 mesh zircon, 15 percent 600 mesh zircon, and 40 percent fused silica (100% −200 mesh, 75% −325 mesh).

The conventional slurry for the outer two coats consisted of:

Colloidal silica—11 lbs
Water—1 lb
Antifoam—16 ml
Refractory powder—19 lbs

The refractory powder was 60 percent ground fireclay grog (90 percent −140 mesh, 50 percent −200 mesh) and 40 percent fused silica (100 percent −100 mesh, 40 percent −325 mesh).

The pattern set-ups used in making the mold were the same type used in Example IV with 260 patterns being mounted on the center tree.

The first and second coats were applied under a vacuum and the remaining coats without vacuum. The fine stucco material was used on the first coat, the intermediate stucco on the second and third coats, and the coarse stucco for the remaining coats. The patterns were removed in an autoclave after which the mold was heated to 1600° F. and placed around a refractory coated, resin-bonded sand core at 250° F. The core cooperated with the interior of the mold to form a hollow sprue gating system having a ¼ inch wall thickness. A partial vacuum of 15 inches mercury below atmospheric was drawn in the vacuum casting chamber to assist in casting of the molten metal. Thirty-one pounds of silicon brass at 1750° F. were poured into the mold cavities.

After cooling, the shell material was easily removed with a pneumatic hammer. The castings were completely satisfactory.

EXAMPLE VII

The advantageous use of hydrated alumina in order to reduce excessive strength after exposure to high temperatures is not limited to refractory compositions prepared with silica-based binders, as will be evident from the following.

Two slurries were made using a colloidal zirconia binder. The binder formula was 500 ml colloidal zirconia (22.5% $ZrO_2$), 5 ml octyl alcohol (antifoam agent), and 1 ml wetting agent. One slurry contained hydrated alumina as the refractory and the other contained calcined alumina (high purity alpha alumina). The viscosity of each slurry was adjusted to a 1000–1050 centipoise range. Specimens were prepared by applying five coats of each slurry and stuccoing each coat with fused alumina (54 grit). Each stuccoed coat was dried in air before applying the next coat. When the specimens were finished and dried, they were fired to 2950° F., a temperature equivalent to that of molten steel, and held for two hours. Modulus of rupture tests were conducted on the specimens after cooling with the following results:

Calcined alumina—2709 psi
Hydrated alumina—138 psi

It will be seen from the foregoing that the use of hydrated alumina or aluminum hydroxide refractory makes it possible to produce ceramic shell molds which have fired strengths that can be selectively controlled at levels far below the fired strengths of molds made with conventional refractories. The greatly reduced fired strengths of the new molds make it easy to remove the mold material from the finished castings and make it possible to employ simplified and expeditiously carried out knockout and cleaning operations. The molds made with hydrated alumina refractory minimize hot tearing of susceptible castings and display a high degree of porosity which minimizes entrapment of air and gasses in the mold cavities.

Many modifications and variations of the invention will be apparent to those skilled in the art in light of the detailed disclosure. Therefore, it is to be understood that, within the scope of the appended claims, the invention can be practiced otherwise than as specifically shown and described.

I claim:

1. An-unfired, multi-layered ceramic shell mold which consists essentially of particulate refractory material and a binder, the refractory material containing in amount by weight from about 20% to 100% hydrated alumina.

2. In a method of making a refractory ceramic shell mold by the repeated steps of dipping a pattern in a slurry to form a coating, the slurry consisting essentially of a binder liquid and a refractory powder, stuccoing the coating while wet with refractory grains, and drying the stuccoed coating, the improvement wherein the refractory powder content of the slurry used for at least some of the coatings contains in amount by weight from 20% to 100% hydrated alumina.

* * * * *